US007278960B1

(12) United States Patent
McGibbons

(10) Patent No.: US 7,278,960 B1
(45) Date of Patent: Oct. 9, 2007

(54) METHOD OF EXERCISING SELECTED MUSCLE TISSUE

(76) Inventor: Steven Paul McGibbons, 2835 W. Canyon Ave., San Diego, CA (US) 92123

( * ) Notice: Subject to any disclaimer, the term of this patent is extended or adjusted under 35 U.S.C. 154(b) by 0 days.

(21) Appl. No.: 11/218,007

(22) Filed: Sep. 1, 2005

(51) Int. Cl.
*A63B 23/00* (2006.01)

(52) U.S. Cl. ..... 482/148; 482/140

(58) Field of Classification Search ..... 482/148, 482/140, 91, 907; D24/214, 200; 601/134–135; 606/237–238
See application file for complete search history.

(56) References Cited

U.S. PATENT DOCUMENTS

| | | | | | |
|---|---|---|---|---|---|
| 2,163,107 | A * | 6/1939 | Shatto et al. | 482/105 |
| 2,754,817 | A * | 7/1956 | Nemeth | 601/134 |
| 3,228,392 | A * | 1/1966 | Speyer | 601/108 |
| 3,278,185 | A * | 10/1966 | Bidopia et al. | 482/124 |
| 3,491,751 | A * | 1/1970 | Walter | 601/41 |
| 3,503,388 | A * | 3/1970 | Cook | 601/41 |
| 3,659,843 | A * | 5/1972 | Kojigian, Jr. | 482/139 |
| 3,809,394 | A * | 5/1974 | Hall | 482/131 |
| 4,441,707 | A * | 4/1984 | Bosch | 482/131 |
| 4,540,173 | A * | 9/1985 | Hopkins, Jr. | 482/124 |
| 4,775,148 | A * | 10/1988 | McLaughlin | 482/124 |
| 4,824,105 | A * | 4/1989 | Goldenberg | 482/113 |
| 5,005,832 | A * | 4/1991 | Van Der Hoeven | 482/124 |
| 5,050,875 | A * | 9/1991 | Lewkovich | 482/128 |
| 5,101,808 | A * | 4/1992 | Kobayashi et al. | 601/44 |
| 5,195,938 | A * | 3/1993 | Robertson | 482/131 |
| 5,401,228 | A * | 3/1995 | McLaughlin | 482/105 |
| 5,538,499 | A * | 7/1996 | Schwenn et al. | 602/20 |
| D373,197 | S * | 8/1996 | Schepper | D24/214 |
| 5,607,378 | A * | 3/1997 | Winston | 482/105 |
| D395,685 | S * | 6/1998 | Cayne et al. | D21/662 |
| 5,913,756 | A * | 6/1999 | Glaser | 482/128 |
| D416,059 | S * | 11/1999 | Cayne et al. | D21/687 |
| 6,319,180 | B1 * | 11/2001 | Kallassy | 482/140 |
| 6,475,124 | B1 * | 11/2002 | Weiss | 482/113 |
| 6,588,125 | B2 * | 7/2003 | Proctor, Sr. | 36/117.1 |
| 6,676,575 | B1 * | 1/2004 | Mayo | 482/104 |
| 7,178,525 | B2 * | 2/2007 | Matula et al. | 128/206.27 |
| 7,204,819 | B2 * | 4/2007 | Berger | 602/26 |
| 2005/0277859 | A1 * | 12/2005 | Carlsmith | 602/20 |
| 2006/0001300 | A1 * | 1/2006 | Harcourt et al. | 297/250.1 |
| 2006/0167396 | A1 * | 7/2006 | Berger | 602/23 |
| 2007/0000495 | A1 * | 1/2007 | Matula et al. | 128/207.18 |

* cited by examiner

*Primary Examiner*—Lori Amerson
(74) *Attorney, Agent, or Firm*—David R. Preston & Assoc.; M. Reza Savari

(57) ABSTRACT

A method of exercising in which selected muscle tissue contacts against externally applied pressure. A user places an object, or member, in contact with a body part, and applies pressure to the member, which is transmitted through the body-contacting surface of the member to the underlying muscle tissue. The pressure provides resistance to muscle expansion as occurs during a muscle contraction. A plurality of body-contacting surfaces is provided, each having different dimensions, which will allow a user to alter the pattern in which pressure is transmitted to the underlying tissue. This will allow a user to select an appropriate body-contacting surface to develop specific portions of muscle, rather than muscles as a whole. Pressure can be applied to the member in various ways, such as by manual force or with the use of a strap that is wrapped around the member and the body part being exercised.

19 Claims, 4 Drawing Sheets

METHOD OF EXERCISING SELECTED MUSCLE TISSUE

CROSS-REFERENCE TO RELATED APPLICATION

This application claims the benefit of Ser. No. 10/887,119 filed on Jul. 8, 2004 by the present inventor.

DESCRIPTION OF PRIOR ART

This invention relates to exercise devices which employ external pressure applied directly to muscles as a form of resistance. While very few exercise products use pressure as a form of resistance, a handful of inventions do involve the application of pressure to muscles. In U.S. Pat. No. 5,607,378, exercise weights are attached to a limb-encircling elastic band, a configuration that requires users to position their muscles in line with the gravitational force exerted by the weights, making it awkward to exercise the muscles of the posterior. Additional devices include U.S. Pat. No. 2,163,107, U.S. Pat. No. 3,278,185, U.S. Pat. No. 4,775,148, U.S. Pat. No. 4,824,105, U.S. Pat. No. 5,195,938, and U.S. Pat. No. 5,401,228 which all involve a means for applying pressure to the abdominal muscles that is attached to a belt wrapped around a user's back. Similarly, U.S. Pat. No. 3,228,392, U.S. Pat. No. 5,005,832, U.S. Pat. No. 5,050,875, and U.S. Pat. No. 5,913,756 also involve the application of pressure to the abdominal muscles, but without the use of a belt. Most of the abdominal exercisers mentioned apply pressure to multiple strips of abdominal muscle, which limits their effectiveness by spreading the total pressure over a relatively broad area. It would be advantageous to be able to isolate individual strips of muscle, allowing a user to exercise each strip a desired amount.

These patents are also limited because they provide a single body-contacting surface, which transmits pressure to underlying muscle tissue in a fixed pattern. It would be advantageous to provide users with multiple differently shaped body-contacting surfaces, which would allow users to develop precise portions of muscles. A user would first select a portion of muscle to develop, and would then choose the body-contacting surface that would transmit pressure in the appropriate pattern. This would be desirable because development in strategic areas of the body can have a beneficial cosmetic effect.

BACKGROUND OF THE INVENTION

The present invention is based on the discovery of a mechanism by which muscle fibers can develop. When a muscle contracts, two basic structural changes occur. One, the muscle shortens in length, and two, its width increases as it bulges outward. The vast majority of resistance exercises and workout products provide resistance to the shortening of muscles, yet they provide no direct resistance to the bulging of muscles. For example, when a weight-lifter performs a biceps curl with a dumbbell, the dumbbell provides resistance oriented in a vector parallel to the major axis of the biceps muscle, and therefore acts to prevent the muscle from shortening. Furthermore, because the muscle fibers that comprise a muscle are oriented parallel to the muscle's major axis, conventional resistance exercises likewise act to prevent individual muscle fibers from shortening, while providing negligible resistance to muscle fiber bulging.

In contrast, the present invention resists muscles and their individual muscle fibers from bulging outward. A user first places a member in contact with a muscle to be exercised, and then applies pressure to the member. The pressure is transmitted to the underlying muscle tissue in a vector that is approximately parallel to the minor axis of the muscle. The user simultaneously contracts the muscle, with the applied pressure resisting the muscle from expanding. Because the muscle fibers are stressed in a novel way, users can get especially impressive results. It is well-known that stressing muscle fibers in a manner in which they are unaccustomed can provide a significant stimulus for growth. By resisting muscle fibers from bulging, this invention taps into a significant area of potential muscle development neglected by other exercises.

Another limitation overcome by this invention is that conventional resistance exercises do not allow people to develop their muscles in a precise and controllable manner. People commonly undertake workout programs hoping to create a certain physique, but end up disappointed with the body changes that actually occur. For example, people who do abdominal exercises in the hopes of creating a flatter appearance, often end up with development in the lower abdominal musculature, which can cause overlying fat to bulge outward, creating the so-called "sit-up bulge." Similarly, many women exercise their gluteus maximus muscles to lift up sagging rear ends, yet they frequently wind up with development in the lower portion of the muscle, which can likewise cause overlying fat to bulge outward.

In order for a person to create an envisioned physique, they need to be able to develop specific areas of muscles. The term "area of muscle" shall herein be defined to refer to any amount of a muscle, including either the entire muscle or any subset, or portion, thereof. People should target strategic portions of muscle where development can lift up sagging fat to give a firmer appearance, while avoiding portions where development can cause overlying fat to bulge out farther. In contrast to other exercises, the present invention offers users the unprecedented ability to selectively develop precise areas of muscle throughout their bodies. A user simply chooses an area of a muscle they wish to develop and then uses a member to apply pressure to and exercise that area.

To understand how this works, it is helpful to first review some basic concepts of neuroanatomy. A typical muscle is made up of hundreds of independently functioning units, which will hereafter be referred to as "muscle units." In a typical muscle contraction, some muscle units are much more active than others, and these units will consequently have a greater stimulus to grow. In order for a person to selectively develop a particular portion of a muscle, they would need to stimulate the muscle units that lie within that portion to a greater extent than the units in the rest of the muscle. However, this task is very difficult to accomplish. The reason for this is that the nervous system uses stored motor programs to execute muscle contractions. Whenever a person decides to contract a muscle, an appropriate motor program is activated, causing a predetermined pattern of muscle units to be stimulated. Motor programs are stored in the brain's long-term memory, so that the same muscle units are activated repetitively over the course of numerous muscle contractions, while others are much less active. As a result, motor programs largely determine which muscle units grow to become fully developed and which ones remain underdeveloped. Because motor programs operate on a subconscious level, they can be very difficult to alter. With conventional resistance exercises, it is virtually impossible for exercisers to selectively activate the muscle units in a particular portion of muscle. For this reason, exercisers can perform countless workout sessions, yet fail to selectively develop their targeted areas.

In contrast, the present invention allows users to circumvent their motor programs to selectively develop portions of muscles. Referring to FIG. 1, a member is shown transmitting pressure to an area of a biceps muscle, with the muscle tissue under pressure shaded to distinguish it from adjacent muscle tissue. As a user contracts their muscle, sensors within the area will detect the resistance supplied by the pressure and communicate this situation to the brain. The brain will respond by activating some of the previously inactive muscle units that are under pressure, which will induce a more forceful contraction in the shaded area. If the user targets the same area for several exercise sessions, the shaded area will undergo growth to a greater degree than adjacent muscle tissue. Furthermore, by tapping into the previously inactive muscle units, a person can achieve significant muscle development, because these underutilized muscle units have much more potential for growth than overutilized muscle units that are likely already maximally developed. Other exercises fail to tap into underutilized muscle units, because they cannot overcome the inherent limitations imposed by motor programs.

Additionally, this invention can be used to modify motor programs to help users achieve their goals. The muscle sensors previously discussed provide biofeedback stimulation informing the user when a targeted area of muscle has contracted. This helps teach the user how to contract their muscle in a way that maximally stimulates the targeted area, which is a key element of optimum muscle development. Through repetitive exercise, a user can retrain their nervous system and modify their motor programs, so that the targeted muscle units are recruited more frequently and at the outset of a muscle contraction. Once modified, these motor programs will theoretically carry over to other exercises as well, so that the targeted muscle units are stimulated more frequently than they would be otherwise. These muscle units should also be more active during the muscle contractions that occur throughout the course of normal daily activities. This can help lead to long-term body reshaping that can continue even after a person has discontinued a regular workout program.

In addition, the present invention is remarkably versatile, allowing a user to develop muscles of the arms, legs, shoulders, chest, abdomen, and buttocks. Furthermore, whereas other exercises often lead to asymmetric muscle development, people can use this invention to correct for existing asymmetries while creating a near-perfectly balanced physique. No other exercise product can produce muscle development in such a precise and controllable manner and over such a broad range of muscles. This invention's versatility is especially noteworthy considering that it is very compact, making it easy to store and transport.

To allow this versatility, the user should have access to member surfaces for body contact that have various shapes and sizes, so that a surface can be selected that is compatible with the area of muscle being exercised. For example, a surface that is large and broad can be used to apply pressure to larger muscles such as the pectoralis or gluteus maximus muscles, while an elongated, narrow surface is better suited for the abdominal muscles and the muscles of the arm. Furthermore, considering that some users will want to develop entire muscles while others may wish to develop specific portions of these muscles, it is important they be provided with member surfaces that will transmit pressure in the appropriate distribution patterns.

One of the primary objectives of this invention is to provide users with a tool for achieving controlled development in their abdominal muscles. The rectus abdominis muscles are anatomically arranged in parallel horizontal strips, and an elongated member can be used to exercise each strip independently. Each strip can be exercised to a variable degree, which represents an improvement over other abdominal exercises that typically lead to general development that is spread throughout the abdominal muscles. An exerciser can use a member to apply a low level of resistance to their lower abdominal strips which will help to tone and flatten this area, and they can apply more resistance to their upper abdominal strips to create an attractive, muscular look.

Another primary objective of this invention is to provide users with an effective way to selectively develop their gluteus maximus muscles. A member may be used to exercise the upper portion, where muscle development can help to lift up sagging tissue and hold it in place, creating an attractive rounded appearance.

This invention is also great for other muscles, such as the triceps, biceps, oblique abdominals, to mention but a few.

Another advantage of the present invention is that it gives users very precise control over the level of resistance that is applied. In contrast to exercise machines and weights, where resistance can only be changed in increments as determined by the product manufacturer, users of this product can apply the exact amount of resistance they choose. Furthermore, resistance can be lowered during the course of a set as a user tires, allowing them to perform additional repetitions and bring their muscles to a greater degree of exhaustion, which is a crucial element of optimal muscle development. With machines and weights, the exerciser must discontinue the set once they can no longer perform a repetition at the selected resistance level, which limits the amount of muscle exhaustion that can be achieved. It has been found that a person can use this invention to effectively exercise their muscles by applying light pressure, while voluntarily contracting their targeted muscle as forcefully as possible, with biofeedback stimulation aiding the user to contract the targeted area.

Additionally, the present invention is a safer alternative to many conventional exercises. Weight lifters, for instance, can sustain crush injuries, muscle and tendon pulls, and various other injuries not seen with this invention. Furthermore, this invention places virtually no strain on the joints, which will help preserve cartilage. This will benefit arthritis patients by providing a pain-free way to develop muscle, in contrast to other exercises that can cause pain flare-ups.

DETAILED DESCRIPTION

Figure 1:
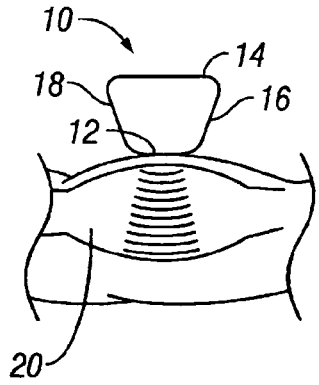
FIG. 1 is a cross-sectional view of a member in contact with an upper arm.

Referring to FIG. 1, a member 10 is depicted, with surface 12 in contact with a biceps muscle 20. If a user grasps surface 14 and applies pressure in a downward direction, this pressure will be transmitted to the muscle tissue approximately in line with surface 12. The size and shape of the surface in contact with the muscle will dictate the pattern in which pressure is distributed to underlying tissue. For example, surface 12 will concentrate pressure into a narrow column of muscle tissue, as depicted by the shaded area of muscle. A relatively large magnitude of resistance can be generated per square inch of muscle, making surface 12 ideal for inducing muscle growth. However, the member may be rotated so that surfaces 14, 16, or 18 contact the muscle. Surfaces that have a relatively large area such as surface 14, will transmit pressure that is spread out over a broader range of muscle tissue, making them suitable for creating muscle tone.

Although members can be constructed from a variety of materials, at the present time a generally rigid material is preferred, which will allow members to efficiently transmit pressure. Members will likely be hollow in order to conserve material. Members may be contoured to fit a person's hand, and may contain ridges, dimples, and the like, to allow for a firmer grip. Surfaces designed for body contact may be covered with a softer material for comfort.

Figure 2:
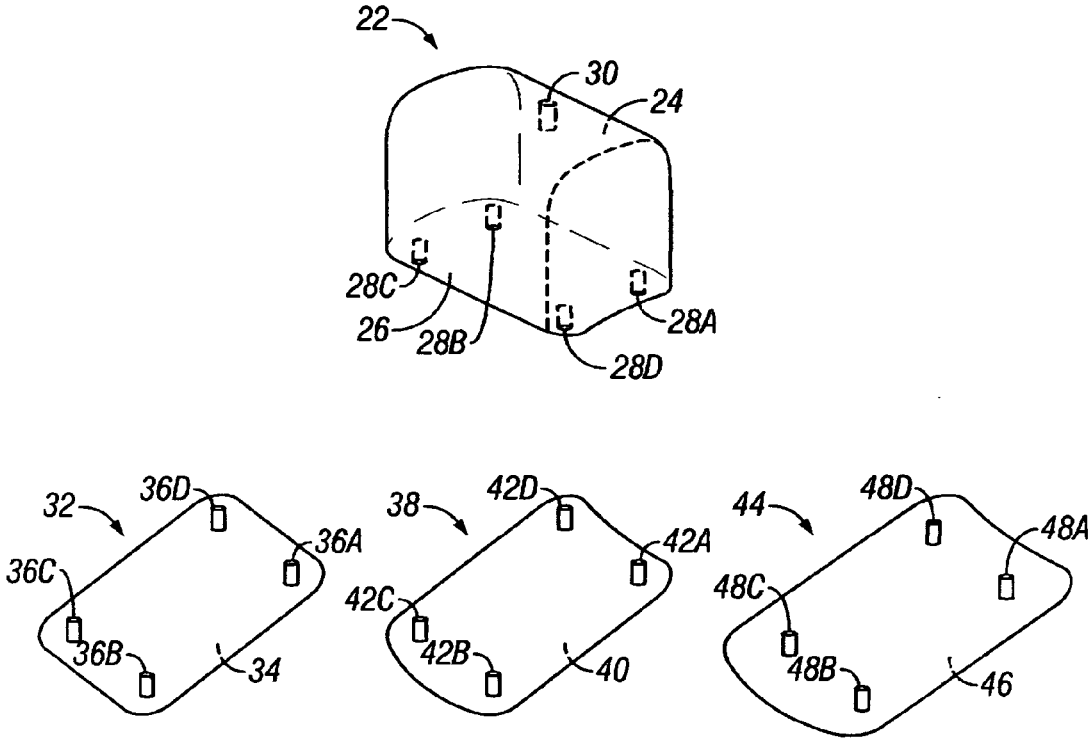
FIG. 2 is a perspective view of a member with reversibly attachable shells.

As shown in FIG. 2, the preferred embodiment for providing users with a variety of surfaces for body contact is to provide a primary member 22 that can reversibly attach to various interchangeable shells 32, 38, and 44. To attach the shells, pegs 36 A-D, 42 A-D, and 48 A-D are inserted into hollow cylindrical structures 28 A-D, with the diameter of the pegs being slightly smaller than the inner diameter of the structures. The pegs fit securely into these structures, similar to the way in which the butt end of a pen fits snugly into a pen cap. Instead of being round, structures 28 A-D may be multi-faceted, so that friction is established with the pegs, which will help keep the shells in place. Alternate mechanisms for attaching shells may be used, such as a hook and loop fastener.

When a user applies pressure to surface 24, either manually or by other means, with an attached shell in contact with a desired area of muscle, pressure will be transmitted through the member and shell to the underlying muscle tissue. Each shell should be "individually dimensioned," a phrase that is herein defined to mean that the body-contacting surface, or shell surface, has a size and shape that is different than any other body-contacting surface present on either a member or another shell. This will allow a user to alter the pattern in which pressure is transmitted to the targeted muscle. Shells 32 and 38 have relatively long and narrow shell surfaces 34 and 40, making them useful for exercising muscles such as the abdominals, triceps, and biceps muscles. These shells can also be used to exercise portions of larger muscles, such as the upper portion of the gluteus maximus muscle. Shell 44 has a relatively large shell surface 46, which is suitable for exercising larger muscles such as the pectoralis or gluteus maximus muscles. Shells can have many different shapes and sizes than those depicted in FIG. 2. Of course, any surface of member 22 may also be used to transmit pressure. For example, the concave surface 26 will distribute pressure over a broader range of tissue that a convex surface, making it appropriate for muscle toning exercises. Surface 26 can also be flat or convex.

Instead of each shell attaching to the primary member, shells can be constructed so that they can attach to each other, one on top of another. In another embodiment, member 22 can be replaced by a single top half that can interconnect with a plurality of different shells.

Figure 3:
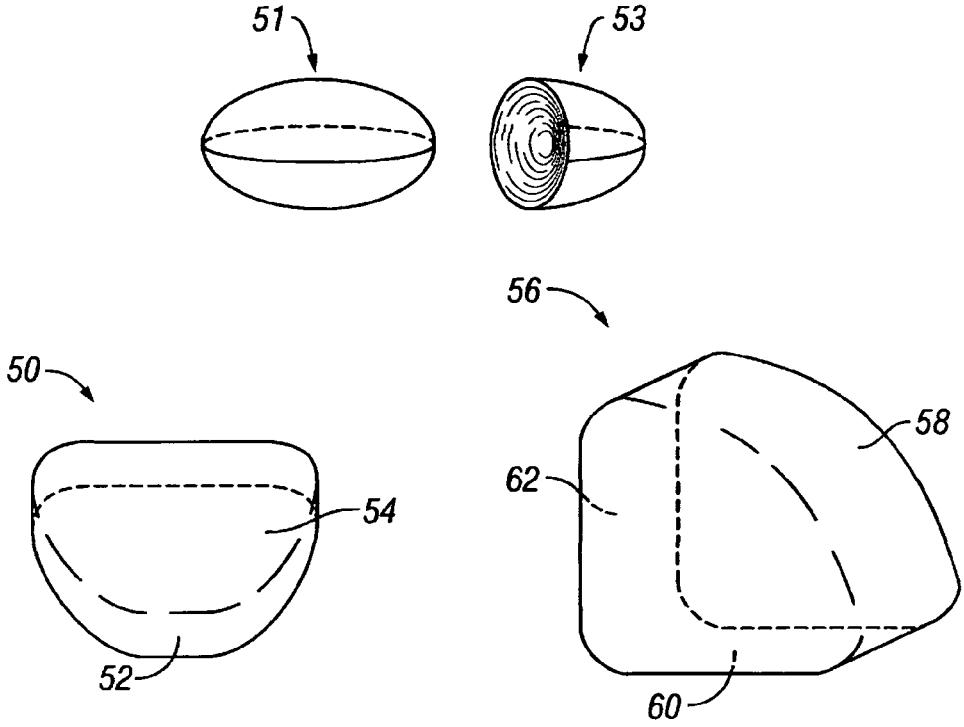
FIG. 3 is a perspective view of various members.

Shells represent the preferred embodiment because they require relatively little material to manufacture, but a user could instead be provided with a plurality of separate members, such as those depicted in FIG. 3. Obviously, many members with different shapes and sizes than those depicted may be provided. Furthermore, the members could interconnect with one another, such as members 51 and 53, to alter the surface that contacts the body. Individual members could have multiple attachment points on different surfaces, which would geometrically increase the potential surfaces available to the user. Members could secure to one another via a mechanism similar to the one depicted in FIG. 2, although many other securing mechanisms are possible.

Figure 4:
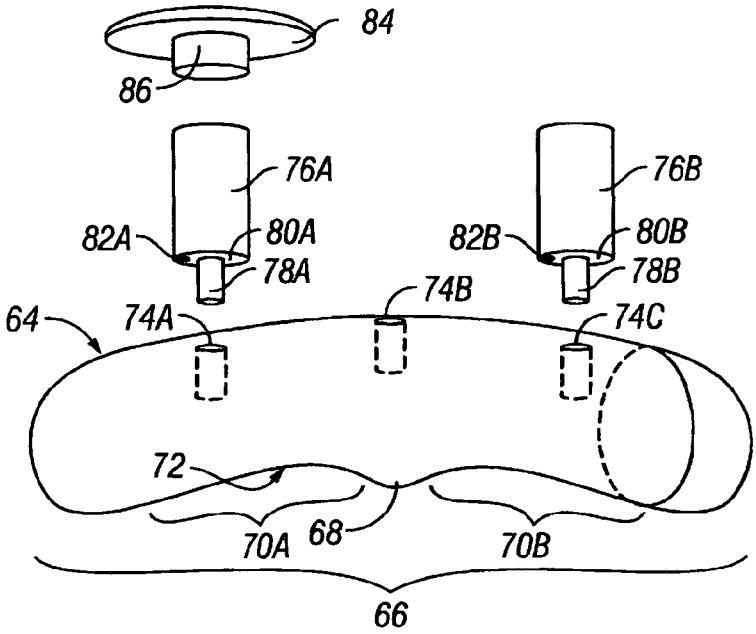
FIG. 4 is a side view of the preferred embodiment for exercising the abdominal muscles.

FIG. 4 depicts the preferred embodiment for exercising the rectus abdominis muscles. Member 64 has a relatively narrow surface 66 that can placed horizontally on the abdomen so that it contacts a single strip of the rectus abdominis muscles. The protuberance 68 is pressed into the vertically oriented depression that is formed by the abdominal musculature at the body's midline, and which runs from the xiphoid process of the sternum down towards the pubic area. This depression may be seen on physically fit individuals with pronounced abdominal musculature. The protuberance helps to prevent the muscle tissue on either side of the depression from shifting medially during exercise, thereby holding the muscle tissue in place to ensure that it derives the maximum benefit from exercise. Lateral segments 70A and 70B are curved, to form a substantially arcuate surface that corresponds generally to the curvature of the abdomen, allowing for flush contact along an entire strip of rectus abdominis muscle. Referring to arrow 72, as the degree of curvature along the minor axis of surface 66 is increased, the surface area for body contact will decrease, which will concentrate pressure into the exercising muscle tissue. Member 64 can also be flipped around and the surface opposite surface 66 used to exercise the abdominal muscles. In use, member 64 is pressed into a user's rectus abdominis muscles while performing sit-ups, crunches, or other abdominal exercises, with the added resistance increasing the effectiveness of these exercises. However, the user can also maintain a fixed body position, while cyclically flexing and relaxing their abdominal muscles. This application eliminates movements that can cause back strain and can be performed either from a seated position or while lying down.

It has been found that a member measuring approximately 6 inches in length, approximately 2 inches in height, and approximately 1½ to 2 inches in width is especially useful. In the event that a user's abdominal morphology does not precisely mirror surface 66, their tissue will naturally conform to it as it expands during exercise, due to the inherent malleability of body tissue. However, members can also be constructed of a slightly flexible material to help compensate for individual variations in body morphology. In an alternate embodiment, the ends of member 64 can be extended so that they contact the oblique muscles, allowing for the simultaneous exercising of rectus abdominis muscles and the oblique abdominals. Alternately, separate members could be connected to the ends of the member 64, which could be pressed inward by the forearms during exercise.

Hollow handles 76A and 76B can reversibly attach to member 64, with the handles being manually grasped to aid the user in applying pressure and maintaining the position of the member on the abdomen. Pegs 78A and 78B are inserted into hollow cylindrical structures 74A and 74C, and connect via a mechanism similar to the mechanism depicted in FIG. 2. As an alternative securing mechanism, pegs 78A and 78B could be threaded, with structures 74 A-C containing complimentary threading, allowing for securement in the customary fashion. Other securing mechanisms are possible. Instead of attaching two handles, a single handle can be attached at 74B. Cap 84 can be attached to handle 76A, with cylindrical outcropping 86 fitting inside handle 76A, the diameter of outcropping 86 slightly smaller than the inner diameter of handle 76A. This configuration allows a user to grasp the handle with one hand and the cap with the other. The handles may be covered with a soft material for comfort, and they may be contoured to fit the hand with ridges, grooves, etc.

Once removed, the handles can themselves be used to apply pressure to smaller muscles such as the oblique abdominals. For this application, it may be desirable to have pegs 78A and 78B be removable so that the pegs do not poke the body during exercise. Alternately, pegs 78A and 78B and end pieces 80A and 80B could be eliminated, with the ends of the handles either fitting onto permanent cylindrical outcroppings on member 64 or inserting into rings carved into the member's top surface. Other mechanisms for securing handles to member 64 are possible. Handles may also be permanently attached to the member.

Instead of handles like those depicted in FIG. 4, any gripping structure attached to the member that may be used to apply downward force will suffice. For example, a T-shaped gripping structure with transverse handles will allow a user to utilize a pulling motion to force the member against their abdomen.

Referring to FIG. 2, member 22 with shell 38 attached can also be used to exercise a single strip of the rectus abdominis muscles, provided that surface 40 is substantially narrow. Shell 38 can be constructed so that surface 40 is convex along its major axis, which will concentrate force into the central portion of the abdomen. Referring to FIG. 3, surface 52 of member 50 will function in a similar manner. Member 50 can also be used to exercise more than one rectus abdominis strip at a time, with surface 54 placed in contact with a plurality of rectus abdominis strips and surface 52 positioned to line up with the inferior boundary of the rib cage.

To increase the versatility of the workout system, the handles of FIG. 4 can also connect with various members. For example, referring to FIG. 2, a handle can attach to member 22, with the handle's peg being inserted into hollow structure 30, which is located at a central position on surface 24. This is the preferred embodiment for exercising the pectoral muscles, and it is also useful for exercising the biceps muscles and the muscles of the legs. Member 22 can have additional attachment points for engaging two handles simultaneously. In order to provide various handle lengths, users may be provided with handles of adjustable length, or they may be provided with a plurality of handles of different lengths. In place of handles, any gripping structure that aids in the application of pressure may be used.

Figure 5:
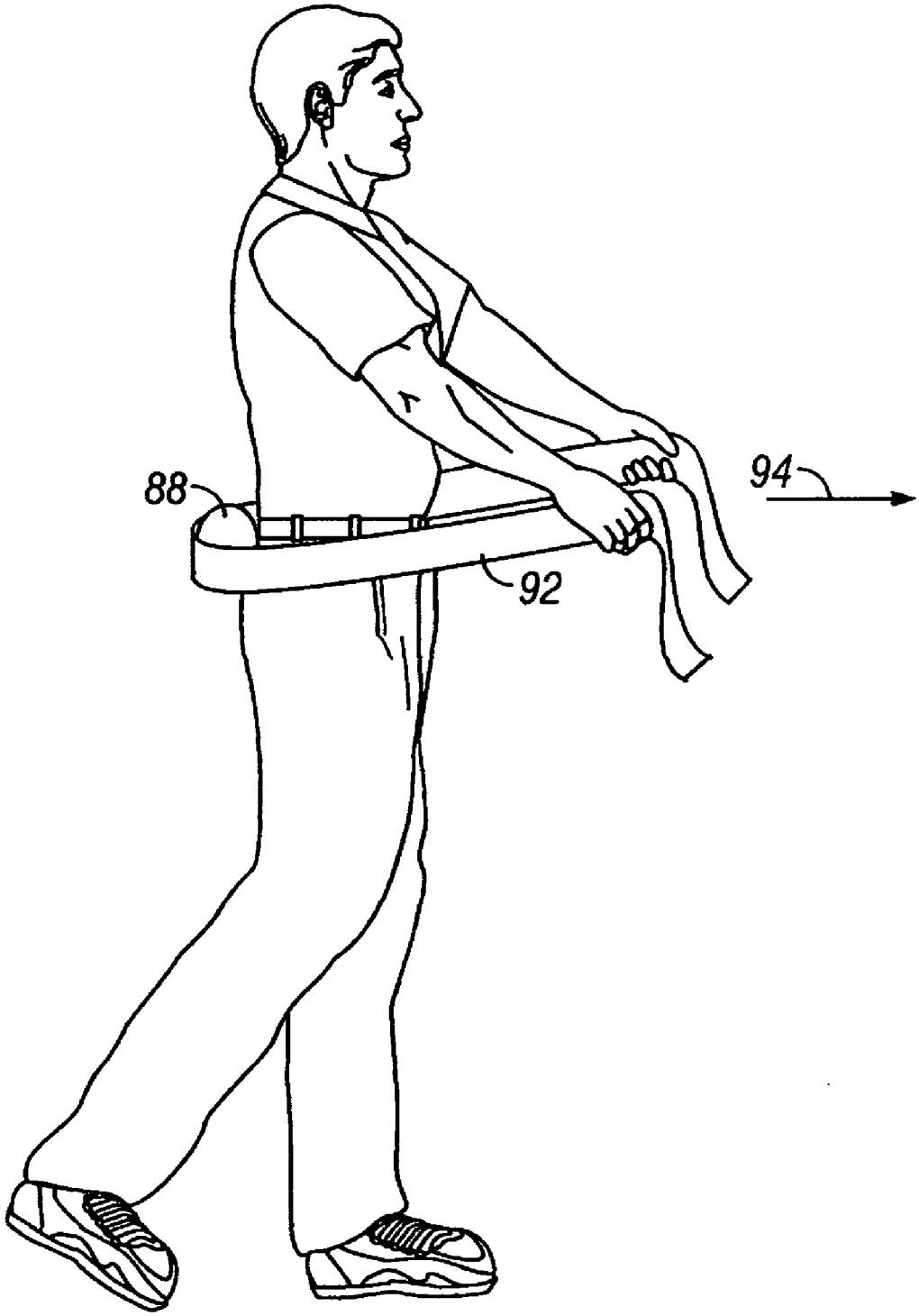
FIG. 5 is a side view showing the preferred embodiment for exercising the gluteus maximus muscles.

Instead of direct manual force, a strap may be employed to apply pressure to a member. A member is first positioned against a desired area of muscle, with the strap partially encircling the member. A user then induces tension in the strap, which will cause the strap to exert pressure on the member. For example, FIG. 5 depicts the preferred embodiment for exercising the gluteus maximus muscles, with a member 88 sandwiched between a user's gluteus maximus muscle and a strap 92. The user grasps the free ends of the strap, and exerts a force on the ends in the direction of arrow 94, causing the strap to exert pressure on the member, which is transmitted to underlying muscle tissue in the usual manner. To enhance the workout, the user can extend a leg out behind them, a position which makes it easier to fully flex the ipsilateral gluteus maximus muscle. A user can also work out the muscles of both sides simultaneously by positioning two members bilaterally. Of course, instead of using a strap, a user can simply manually press a member into their gluteus maximus muscles.

Figure 6:
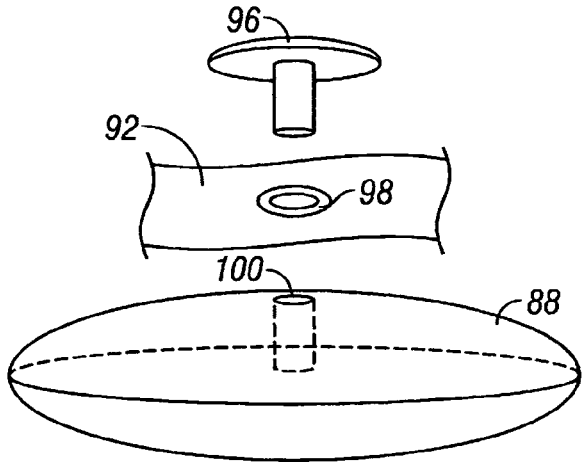
FIG. 6 is a side view depicting a mechanism for attaching a strap to a member.

A mechanism for securing the member to the strap can be provided, which will aid in positioning the member over the desired body part and also help to prevent the member from slipping during exercise. As depicted in FIG. 6, fastener 96 is inserted through grommet 98 and into hollow structure 100, thereby securing member 88 to strap 92. For a more secure fit, the member and strap can attach to each other at a plurality of positions simultaneously. Referring to FIG. 2, strap 92 can also associate with member 22 in a similar fashion. If an exerciser is provided with a plurality of members, each member may interchangeably connect with the strap. In place of fastener 96, a threaded bolt may be used that engages a complimentary threaded insert. Alternative fastening mechanisms, such as snaps or a hook and loop fastener, may also be employed, and this invention should not be construed to be limited by any fastening mechanisms. A member can also be permanently attached to the strap. At the present time, an inelastic strap is preferred, although it has been found that an elastic strap can also be effective. If the strap is, in fact, elastic, the strap may include a central inelastic portion to allow for sturdier securement to the members.

Figure 7:
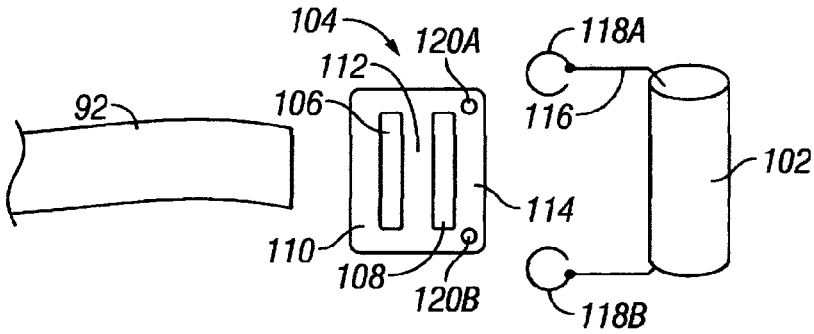
FIG. 7 is a side view depicting a mechanism for attaching a handle to a strap.
Figure 8:
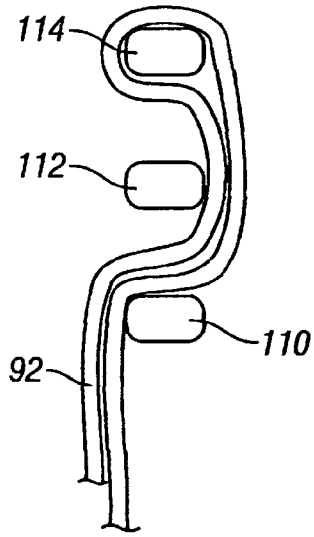
FIG. 8 is a cross-sectional view of a strap secured to a strap slider.

As shown in FIG. 7, handle 102 can be attached at an end of strap 92, with the handle being pushed or pulled to generate tension in the strap. A second handle can also be attached to the other end of strap 92. At the present time, the preferred way to attach a handle is with the use of a strap slider 104 with two laterally extending slots 106 and 108. To secure the strap, a loose end is first threaded through slot 106, then wrapped partway around bar 112, brought through slot 108, then wrapped around bar 114 and finally threaded back through slot 106, a configuration depicted in cross-section in FIG. 8. The use of a strap slider allows the handle to attach at various locations along the strap, allowing the effective length of the strap to be adjusted according to the body part being exercised. The handle can be attached to the strap slider with cord 116 passing through hollow handle 102, and hooks 118A and 118B that engage holes 120A and 120 B. To simplify the exercise system, the same handles of FIG. 4 can be used to engage the strap. For example, hook 118A and cord 116 may be passed through handle 76A via hole 82A, with hook 118A then engaging hole 120A, thereby securing the handle to the strap slider. Instead of a strap slider, the strap may be equipped with grommets at spaced intervals, designed to engage hooks 118A and 118B. Many other possible mechanisms exist for attaching handles to the strap.

A strap-plus-member configuration is also the preferred embodiment for exercising the triceps muscles, and it is very effective for the biceps muscles as well. With the strap partially encircling the member and upper arm, a user grasps both ends of the strap with the contralateral hand, and applies a force to the strap directed away from the member, which will cause the strap to exert pressure on the member. As an exercising aid, a single handle may be attached to the strap with both ends of the strap threaded together through a strap slider along the same route depicted in FIG. 8.

In another embodiment, the free ends of the strap may be attached to stationary objects such as table legs, door handles, etc., so that the user does not have to use their arms to generate tension in the strap.

The strap can also be wrapped completely around the exercising body part, and secured to make a closed loop. For example, a strap may be wrapped around a user's abdomen and lower back, with a member such as the one depicted in FIG. 4 sandwiched between the strap and the abdominal muscles. The user can cyclically contract their abdominal muscles, an action which will increase the circumference of the lower torso, and stretch the strap, with the resultant tension being channeled through the member in the usual fashion. This embodiment frees up the user's hands, making it ideal for use during everyday activities such as riding in a car or working at a desk. The user can also sit in a chair, with the strap wrapped around their abdominal muscles and the back of the chair, thereby alleviating some of the pressure on the body cavity. To form a closed loop, the strap slider of FIG. 7 can be used. Alternative securing mechanisms, such as a buckle or a hook and loop fastener, may also be used.

A closed-loop arrangement may also be used to exercise the muscles of the upper legs and buttocks, with the strap wrapped around a member and the muscle to be exercised in the posterior, and either the upper legs or waist in the anterior. A user can generate tension in the strap by extending a leg out behind them, as occurs during walking. Two members can be positioned bilaterally, to exercise both sides simultaneously. A closed-loop arrangement may also be used to exercise the muscles of the limbs. To enhance the workout, a user can grasp and pull the portion of the loop opposite the member, an action which will increase the amount of pressure that is channeled through the member.

In an alternate embodiment, the ends of the strap may be secured to a rigid bar that is pushed or pulled during exercise. The bar could also be positioned behind the back of a chair during abdominal exercises.

As an alternative to providing a strap, elastic material may be integral with an article of clothing such as a shirt or a pair of shorts, with members placed between the elastic material and the muscle to be exercised. In an alternate embodiment, elastic cords may be used in place of a strap, with the cords reversibly engaging various members.

Alternate ways of applying pressure to members may also be employed. For example, referring to FIG. 3, if a person were to sit on surface 58 of member 56, with surfaces 60 and 62 in contact with a chair, a reactive force would be transmitted by the member, and the person could contract the appropriate muscles against this force.

In an alternate embodiment, a spring engaging a handle, with the outward facing end of the spring engaging interchangeable members may be used to apply pressure to various muscles. Alternately, one end of a spring could attach to a member designed for body contact, with the other end interfacing with a strap. Other means of applying pressure to the members are conceivable, and this invention should not be considered limited by any of the above stated means.

Other modifications may be envisioned by those skilled in the art. Although the preferred embodiments have been disclosed and claimed herein, it is to be understood that the scope of the present invention is not to be limited except in accordance with the appended claims.

What is claimed is:

1. An exercise device comprising:

a) an elongated, substantially narrow member having a body-contacting surface that is curved lengthwise corresponding generally to the curvature of the anterior part of the abdomen;

b) a protuberance in the middle of said body-contacting surface, said protuberance forming a ridge having angled sides such that said protuberance is shaped to generally correspond to the vertically oriented depression at the midline of the rectus abdominis muscle;

c) means for gripping said member for the purpose of applying pressure, said means projecting at least two inches above said member, such that when said member is placed horizontally against the abdomen with said protuberance positioned against said vertically oriented depression, said pressure applied to said member will be transmitted to underlying muscle tissue, said protuberance further concentrating pressure into the central portion of the rectus abdominis muscle, said pressure resisting the contraction of said underlying muscle tissue so that it is exercised to a greater degree than adjacent uncovered muscle tissue, thus allowing a user to develop precise portions of their rectus abdominis muscle.

2. The exercise device of claim 1, wherein said gripping means are detachable.

3. The exercise device of claim 1, wherein said gripping means comprise vertically oriented, rod-shaped handles.

4. The exercise device of claim 1, further comprising a strap, said strap being able to wrap around said user's lower torso and said member, forming a closed loop and establishing the position of said member against said user's abdomen, such that abdominal expansion will induce tension in said strap, causing said strap to exert pressure on said member, said pressure being transmitted to underlying muscle tissue.

5. A method of exercising the abdominal muscles comprising the steps of:

a) providing an exercise device having an elongated, substantially narrow member having a body-contacting surface that is curved lengthwise corresponding generally to the curvature of the anterior part of the abdomen, a protuberance in the middle of said surface, said protuberance forming a ridge having angled sides, such that the protuberance is shaped to generally correspond to the vertically oriented depression at the midline of the rectus abdominis muscle;

b) selecting an area of the rectus abdominis muscle to exercise;

c) placing said member in contact with said area, such that said protuberance contacts said vertically oriented depression;

d) applying a force on said member in an inward direction; and e) contracting said area against said force;

whereby said area is exercised to a greater degree than adjacent uncovered muscle tissue, allowing a user to develop precise portions of their rectus abdominis muscle.

6. The method of claim 1 wherein said exercise device further comprises gripping means to aid in the application of said force.

7. An exercise device comprising:

a) a plurality of members, said members being substantially rigid and having at least one curved surface, one or more of said members being chosen by an exerciser and placed in overlying relation to a selected area of muscle;

b) a strap partially encircling at least one of said chosen members, a force being exerted on said strap, causing tension to be generated in said strap, so that pressure is transmitted to said selected area of muscle, said plurality of members being individually dimensioned so that a user may alter the transmission pattern of said pressure;

c) a securing means consisting of slots present in at least one of said members, allowing the strap to be weaved through for securement at various locations along the strap;

whereby said pressure provides concentrated resistance to said selected area of muscle, such that during exercise when the selected area expands in girth, the pressure resists the expansion of the selected area, such that the selected area is exercised to a greater degree than adjacent uncovered muscle tissue, thus allowing a user to develop precise portions of muscle tissue.

8. The exercise device of claim 7 wherein said slots consist of 4 or more slots, allowing said member to be rotated and placed against said selected area of muscle in different orientations.

9. A method for firming a portion of the gluteus maximus muscle by applying pressure to said muscle as said muscle contracts in order to resist muscle bulging, the method comprising the steps of:

a) providing at least one substantially rigid member having at least one curved body-contacting surface;

b) providing a strap partially encircling said member;

c) selecting an area of the gluteus maximus muscle to be exercised;

d) placing said member in contact with said area of the gluteus maximus muscle;

e) manually pushing forward on said strap to put pressure on the muscle, thereby causing resistance to be transmitted through said member to said area of the gluteus maximus muscle to prevent the muscle from bulging; and f) contracting said area of the gluteus maximus muscle;

whereby said pressure resists said selected area of the gluteus maximus muscle from expanding in girth, so that said selected area of the gluteus maximus muscle is exercised to a greater degree than adjacent uncovered muscle tissue, thus allowing a user to develop precise portions of the gluteus maximus muscle and minimize strain on the joints.

10. The method of claim of 9, wherein said body-contacting surface has at least one of a horizontal or a vertical curvature that is opposed to the curvature of the gluteus maximus muscle.

11. The method of claim of 9, wherein said body-contacting surface is convex.

12. The method of claim 9, wherein the portion of the member that contacts the gluteus maximus muscle is no more than 6 inches in at least one of a horizontal or vertical direction.

13. The method of claim 9, wherein said strap further comprises handles attached to said strap.

14. The method of claim 9, wherein said strap is elastic.

15. The method of claim 9, wherein said strap is inelastic.

16. A method for exercising an area of muscle comprising the steps of:

a) providing at least one member having at least one curved body contacting surface;

b) providing multiple body contacting surfaces, by way of said member being flippable or rotatable, or by way of providing a plurality of interchangeable members, each having individually dimensioned surfaces, or by way of providing one or more rigid, individually dimensioned shells, said shells being able to be placed in contact with said member, thus allowing the transmission pattern of said pressure to be altered, giving said user a greater degree of control over the muscle tissue that is developed;

c) providing a strap partially encircling said member;

d) selecting an area of muscle to be exercised;

e) placing said member in an overlying relation to said area of muscle;

f) manually exerting a force on the opposing sections of said strap in a direction oriented away from said at least one member, thereby generating tension in said strap, causing pressure to be transmitted through said at least one member to said area of muscle to prevent the muscle from bulging; and g) contracting said area of muscle;

whereby said pressure resists said selected area of muscle from expanding in girth, so that said selected area of muscle is exercised to a greater degree than adjacent uncovered muscle tissue, thus allowing a user to develop precise portions of muscle tissue.

17. The method of claim 16, wherein said strap is elastic.

18. The method of claim 16, wherein said strap is inelastic.

19. The method of claim 16, wherein said strap further comprises handles attached to said strap.

* * * * *